US008397619B2

(12) United States Patent
Genihovich et al.

(10) Patent No.: US 8,397,619 B2
(45) Date of Patent: Mar. 19, 2013

(54) ARMOR

(75) Inventors: Shmuel Genihovich, Nazareth Ellite (IL); Mark Pak, Karmiel (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 0 days.

(21) Appl. No.: 11/980,378

(22) Filed: Oct. 31, 2007

(65) Prior Publication Data

US 2008/0223204 A1 Sep. 18, 2008

(30) Foreign Application Priority Data

Nov. 8, 2006 (IL) ..... 179126

(51) Int. Cl.
*F41H 5/02* (2006.01)

(52) U.S. Cl. ..... 89/36.02; 89/904; 89/918

(58) Field of Classification Search ..... 89/36.01–36.07, 89/901–939; 428/911
See application file for complete search history.

(56) References Cited

U.S. PATENT DOCUMENTS

| | | | | | |
|---|---|---|---|---|---|
| 3,722,355 | A | * | 3/1973 | King | 89/36.02 |
| 4,048,365 | A | | 9/1977 | Hoover | |
| 4,061,815 | A | * | 12/1977 | Poole, Jr. | 428/215 |
| 4,550,044 | A | * | 10/1985 | Rosenberg et al. | 428/101 |
| 4,608,717 | A | * | 9/1986 | Dunbavand | 2/2.5 |
| 4,732,803 | A | * | 3/1988 | Smith, Jr. | 428/212 |
| 4,868,040 | A | * | 9/1989 | Hallal et al. | 442/234 |
| 5,272,954 | A | | 12/1993 | Crouch | |
| 5,327,811 | A | * | 7/1994 | Price et al. | 2/2.5 |
| 5,349,893 | A | * | 9/1994 | Dunn | 89/36.05 |
| 5,830,548 | A | * | 11/1998 | Andersen et al. | 428/36.4 |
| 5,851,932 | A | * | 12/1998 | Dickson et al. | 442/135 |
| 5,943,694 | A | * | 8/1999 | Moureaux et al. | 2/2.5 |
| 6,047,626 | A | * | 4/2000 | Lair et al. | 89/36.08 |
| 6,119,575 | A | * | 9/2000 | Dragone et al. | 89/36.05 |
| 6,127,291 | A | * | 10/2000 | Coppage et al. | 442/135 |
| 6,253,655 | B1 | * | 7/2001 | Lyons et al. | 89/36.02 |
| 6,389,594 | B1 | * | 5/2002 | Yavin | 2/2.5 |
| 6,609,452 | B1 | * | 8/2003 | McCormick et al. | 89/36.01 |
| 6,703,104 | B1 | * | 3/2004 | Neal | 428/118 |
| 6,979,172 | B1 | * | 12/2005 | Mackenzie | 415/9 |
| 7,712,407 | B2 | * | 5/2010 | Ravid et al. | 89/36.01 |
| 2004/0067376 | A1 | * | 4/2004 | Arao et al. | 428/467 |
| 2005/0188831 | A1 | * | 9/2005 | Squires et al. | 89/36.02 |
| 2007/0180982 | A1 | * | 8/2007 | Dagher et al. | 89/36.02 |
| 2007/0283801 | A1 | * | 12/2007 | Gallo | 89/36.02 |

(Continued)

FOREIGN PATENT DOCUMENTS

| | | |
|---|---|---|
| EP | 0 024 713 A2 | 3/1981 |
| EP | 0 056 703 | 7/1982 |

(Continued)

*Primary Examiner* — Samir Abdosh
(74) *Attorney, Agent, or Firm* — Greenberg Traurig, LLP

(57) ABSTRACT

An armor panel comprising an armor member made of a laminated material, having a predetermined ballistic capability and a first flexural strength. The armor panel has a covering layer having a second flexural strength essentially lower than the first flexural strength. The covering layer is bonded to the armor member. The layer is made of a fiber reinforced material such that overall flexural strength of the armor panel is greater than twice the first structural strength. The overall ballistic capability of the armor panel is at least the same as that of the predetermined ballistic capability of the armor member.

14 Claims, 3 Drawing Sheets

U.S. PATENT DOCUMENTS

| | | | | |
|---|---|---|---|---|
| 2007/0295198 | A1* | 12/2007 | Booher | 89/36.02 |
| 2008/0307553 | A1* | 12/2008 | Jbeili et al. | 2/2.5 |
| 2008/0307953 | A1* | 12/2008 | Carberry et al. | 89/36.02 |
| 2009/0293711 | A1* | 12/2009 | Altergott et al. | 89/36.02 |
| 2010/0024633 | A1* | 2/2010 | Piscitelli | 89/36.02 |

FOREIGN PATENT DOCUMENTS

| | | |
|---|---|---|
| EP | 0 417 929 | 3/1991 |
| ES | 2013658 | 5/1990 |
| GB | 1260111 | 1/1972 |

* cited by examiner

| No. of Piles | Dyneema® | | | |
|---|---|---|---|---|
| | Weight (kg) | Thickness (mm) | Structural Strength(kg) | V50 17GRN FSP (m/s) |
| 27 | 1.26 | 8.5 | 274 | <800 |
| 29 | 1.34 | 9.0 | 360 | 835 |
| 31 | 1.41 | 9.8 | 356 | 882 |
| 33 | 1.48 | 10 | 375 | >882 |
| Ref. | 1.2 | 9.1 | 44 | 820 |

Table. 1

| No. of Piles | Spectra | | | |
|---|---|---|---|---|
| | Weight (kg) | Thickness (mm) | Structural Strength(kg) | V50 17GRN FSP (m/s) |
| 27 | 1.23 | 8.5 | 151 | <814 |
| 29 | 1.3 | 9.0 | 168 | <818 |
| 31 | 1.37 | 9.6 | 180 | <843 |
| 33 | 1.44 | 10 | 152 | >843 |
| Ref. | 1.2 | 9.1 | 44 | 820 |

Table. 2

FIG. 3B

ARMOR

FIELD OF THE INVENTION

This invention relates to armor panels, more particularly structurally reinforced armor panels.

BACKGROUND OF THE INVENTION

It is known in the field of armament to use laminated armor panels for purpose of protection against incoming threats, made of soft layers such as Polyethylene (PE) or Polyurethane (PU). These soft layers have a low stiffening moment, are easily worn out, sensitive to environmental conditions, liquids and high temperatures. This may cause armor panels made of such layers to deform due to various reasons, e.g. stepping on the panel etc., forming week spots in the armor. In addition, armor panels having a curved or non-planner shape may be unable to keep that shape for a long period of time due to structural weakening of their layers.

The loss of shape may influence both the effectiveness of the armor and/or render it unfit for use, e.g. wrong shape may prevent proper close contact mounting of the armor on a body to be protected.

A deformed armor panel may remain in use until its complete wearing out, or if possible, it may be repressed by a pressing process similar to that in which the armor panel was made, especially in case of thermoplastic resin panels.

Also, it has been suggested to reinforce an armor panel by adding a reinforcing matter into its soft layers to maintain structural rigidity, or by adding layers thereto to increase the structural strength thereof, as disclosed in U.S. Pat. No. 4,061,815.

It is also known from the art to use armor panels in which an armor member is wrapped with or covered by a material allowing to improve durability and serve as protection of the armor member from the environment, i.e. rain, hail etc.

SUMMARY OF THE INVENTION

According to a first aspect of the present invention, there is provided an armor panel comprising an armor member made of a laminated material, having a predetermined ballistic capability and a first flexural strength, and a covering layer having a second flexural strength essentially lower than said first flexural strength, and being bonded to said armor member, said layer being made of a fiber reinforced material, overall flexural strength of said armor panel being greater than twice the first structural strength, and overall ballistic capability of said armor panel is at least the same as that of said predetermined ballistic capability of the armor member.

The thermal expansion coefficient of the armor member and its covering layer may be essentially similar, which may provide for more durable bonding therebetween, in particular, the thermal expansion coefficient of said armor member and said covering layer may be such that in combination, the thermal expansion coefficient does not decrease the elasticity modulus of an armor panel, when it is comprised of an armor member alone, without a covering layer. Said heat expansion coefficient is particularly useful when said bonding involves heating and cooling of said armor member and said layer.

The armor may be of both planar and non-planar shape, and may be produced by first fabricating said armor member to have said planer or non-planer shape, and then bonding the covering layer thereto. In case the armor member is of a curved shape, the flexural strength provided by said covering layer also allows the armor to maintain its shape for a considerably longer time and/or higher loads than an armor without such covering layer.

The armor member may be made of a plurality of plies of a material which is free of any metal or ceramics, for example, it may be made of a plurality of Polyethylene plies (usually around 30) which create a curved plate having a maximum load of about 500N.

The material from which the covering layer is made may be a fiber reinforced resin, for example, it may be a carbon or Aramide reinforced epoxy. The covering layer may be a non-laminated layer, e.g. it may be in the form of a single ply of a thickness about the same as the thickness of one ply in the laminated armor member.

The covering layer made of the above fiber reinforced resin may have a flexural strength in the range of about 30-40% of the flexural strength of the armor member, being essentially thinner than the armor member. For example, the thickness of the covering layer may be thinner than the thickness of one ply of PE, e.g. it may constitute about 2% of the thickness of the armor member.

According to a second aspect of the present invention there is provided a method for stiffening an armor member made of a laminated material with a maximal thickness of plies being $T_{max}$, having a predetermined ballistic capability and a first flexural strength, said method comprising:

a. providing a non-laminated ply of a covering material having a second flexural strength essentially lower than said first flexural strength and a thickness not exceeding 10% of $T_{max}$;

b. bonding said ply to said armor member on at least one side using a hot pressing process, to form an armor panel, wherein the overall flexural strength of said armor panel being greater than twice the first structural strength, and overall ballistic capability of said armor panel is at least the same as that of said predetermined ballistic capability of the armor member.

For example, the covering material may be made of a fiber reinforced resin. The area weight of the fabric fibers within the prepreg may range between 200 and 9000 g/m$^2$ and the fibers are preferably made of a high specific strength composite such as Carbon or Aramide, although they may also be made of other materials, e.g. Fiberglass, etc. The amount of resin within said covering material may range between 30-50%. The pattern of the fibers may vary according to the geometry of said armor and its various uses, and may be uni-directional, bi-directional or even woven-roving.

The covering layer may constitute a front layer facing in the direction of an incoming projectile, front and back layers facing to and away from such projectiles respectively, and may even fully encapsulate the armor member.

The armor panel designed according to the present invention may have due to said covering layer, increased flexural strength with a reduced number of layers in said armor member, and therefore a reduced overall weight, yet still achieving at least the same ballistic effectiveness, in comparison with an equivalent non-covered armor member.

BRIEF DESCRIPTION OF THE DRAWINGS

In order to understand the invention and to see how it may be carried out in practice, an embodiment will now be described, by way of non-limiting example only, with reference to the accompanying drawings, in which:

FIG. 3A and 3B are test results of FIG. 2 in the form of a diagram and two tables accordingly.

DETAILED DESCRIPTION OF EXEMPLARY EMBODIMENTS

Figure 1:
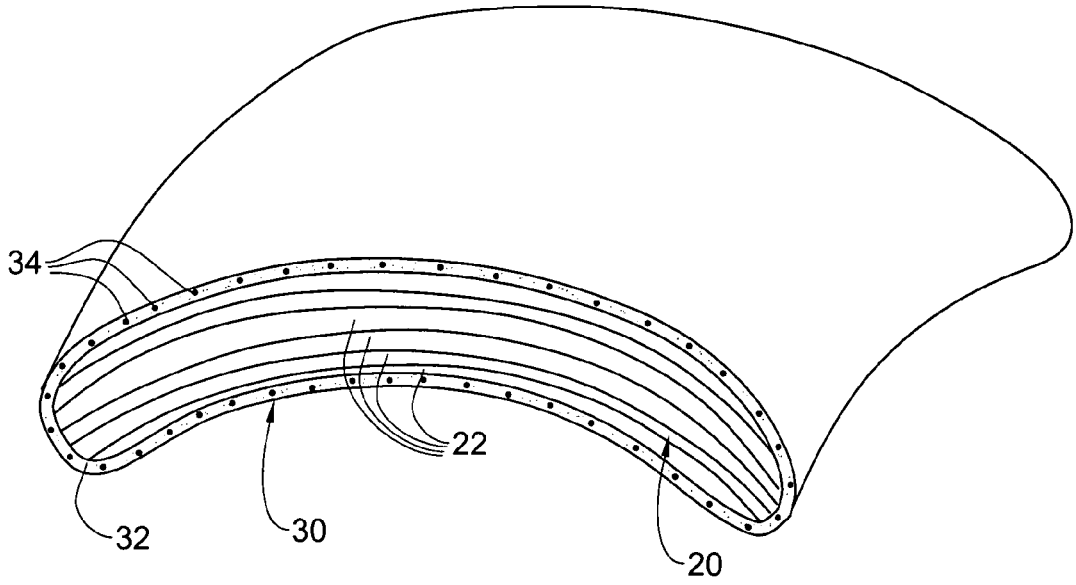
FIG. 1 is a schematic isometric, partially sectioned view of an armor panel according to the present invention.

FIG. 1 shows an armor panel generally designated 10, comprising an armor member 20 in the form of a plurality of Polyethylene (PE) plies 22. For example, the armor member may in the form of the EOD-8 breast plate, manufactured by Med-Eng Systems (MES), CA (http://www.med-eng.com/default.asp). It has about 30 plies of a thickness 8 mm. The plate has a ballistic efficiency required to protect its wearer from armor piercing projectiles of 7.62 mm caliber.

The armor panel 10 further comprises a covering layer 30 made of curable resin 32 on a fiber matrix 34, which has, on its own, a substantially low flexural strength, lower than that of the armor member 20. The covering layer 30 fully encapsulates the armor member 20.

For example, the covering member may be made of an epoxy carbon fabric prepreg reinforced with a carbon fiber matrix, and having a high viscosity, for example the FT102 prepreg material produced by "epo gmbh". Such an epoxy is adapted for a great range of curing temperatures from 80° C. to 160° C., and typically undergoes curing at 125° C. for 60 minutes. The resin contents may range from 30% to 50%, and is 35% in the present example. The fibers have a fiber area weight of 650 g/m$^2$. Thermal expansion coefficient of the prepreg is similar to that of the PE plies. The covering layer 30 is bonded to the armor member 20 by a pressing process under an increased temperature and pressure, which soften the materials of the covering layer and the armor member to the extent needed for the bonding but not affecting the characteristics of the PE layers 22 and do not damage its ballistic properties. For example, with the materials indicated above, the pressure may be in the range of about 0-4 Bar, and the temperature may be about 90° C.

Figure 2:
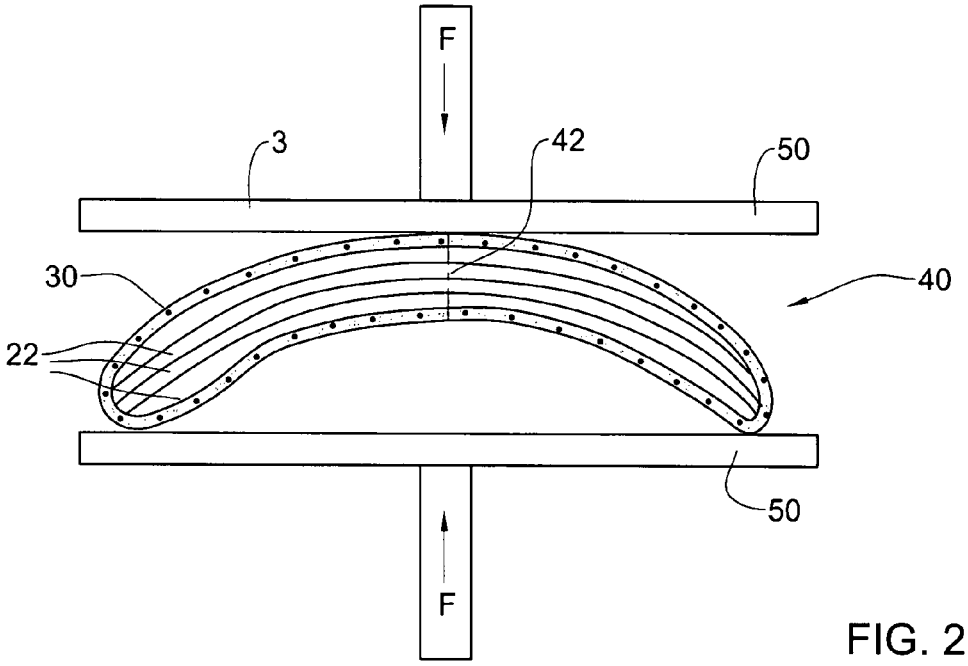
FIG. 2 is a schematic view illustrating the pressure applied to the a test model of the armor panel of FIG. 1 during a flexural strength test.

Tests for flexural strength have been carried out on several test models 40 of the armor panel 10 as described above, made of PE by two manufacturers—DYNEEMA®, and SPECTRA, and on a reference model 60. The tests included placing a non-planar shaped model 40 between two essentially flat plates 50 and applying a pressing force F to the test model 40 and the reference model 60, as shown in FIG. 2. As seen in FIG. 2, the force F was applied roughly along the mid-line 42 of the model. The test models 40 comprised armor members having a curvature radius of 260 mm and a length of 350 mm, which varied in the number of PE plies 22 therein, and all had the same covering layer 30 made of a single ply of the prepreg of thickness 0.5 mm. The reference model 60 was an EOD-8 breastplate, comprising an armor member having 30 PE plies without a covering layer 30. The results of the tests are shown in FIGS. 3A and 3B.

Figure 3A:
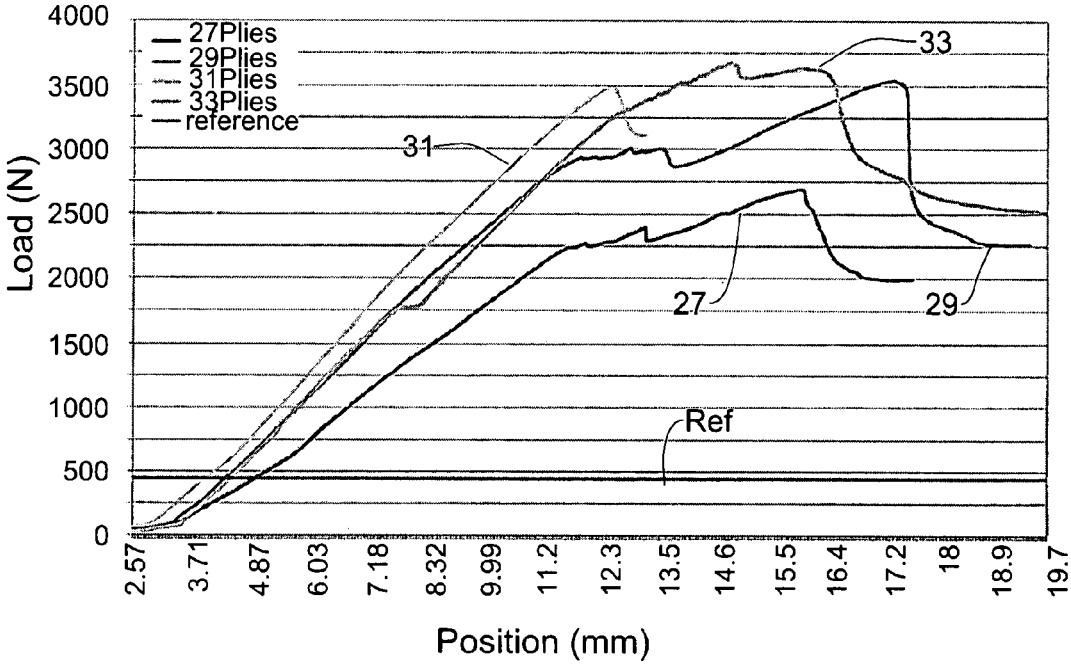

The diagram and tables shown in FIGS. 3A and 3B disclose test results for armor panel models with armor members made of PE by Dyneema® and Spectra. It is clearly noticeable from Diagram. 1 in FIG. 3A and corresponding Table. 1 in FIG. 3B, that the flexural strength of the armor panel 10 is increased by at least six times for twenty seven plies of PE (2740N as opposed to 450N) as indicated by line 27 on the diagram, and by more than eight times when 33 plies of PE are used (3750N as opposed to 450N) as indicated by line 33 on the diagram. These results demonstrate a drastic increase in the order of magnitude of the flexural strength, i.e. withstanding hundreds of kg force as opposed to tens of kg force.

It is also noticeable from the test results that the ballistic effectiveness of the armor panel with both the Dyneema® and Spectra PE armor members does not fall short of that of the reference panel when a similar number of plies is used. Furthermore, in case the Dyneema® PE is used, the armor panel has a ballistic effectiveness which is higher than the reference model, when having less plies (twenty nine as opposed to thirty in the reference panel). This demonstrates that when using an armor member comprising a covering layer, the number of PE plies may be reduced without deteriorating the ballistic effectiveness of the armor panel.

It has also been established in experiments, that the ballistic effectiveness of the armor panel 10 is not affected by the pressure and the temperature under which the bonding process took place.

In order to improve the flexural strength of the armor member 10, the covering layer does not have to encapsulate the armor member, but rather may be in the form of front and back layer layers 10' and 10", respectively, as shown in FIG. 4, though in this case the increase of flexural strength is not so high as in the case of full encapsulation.

It should be noted that tests have also been performed on an armor panel having the armor member 10 as described above, and a covering layer made of a fiberglass ply of approximately the same thickness, and yielded significantly worse results.

The plies of the armor member 10 may be made of several materials, for example, several plies of PE followed by several plies of Polyurethene. The covering material may also be constituted by several plies, with the possibility of having plies of the same covering being reinforced with different fibers, e.g. some plies reinforced with Carbon fiber, some with Aramide. Furthermore, parameters of the armor layer and the covering layer may be optimized to minimize the weight and the thickness of the armor panel for a given ballistic efficiency.

Those skilled in the art to which this invention pertains will readily appreciate that numerous changes, variations and modifications can be made without departing from the scope of the invention mutatis mutandis.

The invention claimed is:

1. An armor panel, comprising:

an inner armor member including a plurality of plies made of a material which is free of any metal or ceramics, said armor member being capable of withstanding a maximal bending load F1 applied thereto along a mid-line of the armor member oriented perpendicular thereto, said armor member having a predetermined ballistic capability B1; and an external covering layer at least partially encapsulating said armor member, said external covering layer being formed of a fiber reinforced resin, the external covering layer being bonded to said armor member and having a thickness not exceeding 10% of that of said armor member and is not capable of withstanding the load F1 on its own;

whereby said armor panel is capable of withstanding a bending load F2>2F1 applied thereto along the mid-line of the armor panel while having an overall ballistic capability B2, which is at least no less than B1.

2. An armor panel according to claim 1, wherein said armor panel is of a non-planar shape.

3. An armor panel according to claim 2, wherein said armor member has a non-planar shape.

4. An armor panel according to claim 3, wherein said plies are made of Polyethylene.

5. An armor panel according to claim 3, wherein said plies are made of several different materials.

6. An armor panel according to claim 1, wherein said external covering layer is formed of a fiber fabric prepreg.

7. An armor panel according to claim 6, wherein the weight area mass of fibers within the prepreg, ranges between 400 and 1000 g/m2.

8. An armor panel according to claim 1, wherein the fibers are made of Carbon or Aramide.

9. An armor panel according to claim 1, wherein the amount of resin within said prepreg is between 30-50%.

10. An armor panel according to claim 1, wherein the fibers of said fiber reinforced resin of said external covering layer are arranged in a uni-directional pattern.

11. An armor panel according to claim 1, wherein the fibers of said fiber reinforced resin of said external covering layer are arranged in a bi-directional pattern.

12. An armor panel according to claim 1, wherein the fibers of said fiber reinforced resin of said external cover layer are arranged in a woven-roving pattern.

13. An armor panel according to claim 1, wherein the load F1 is at least 50 kg.

14. An armor panel according to claim 1, wherein said external covering layer fully encapsulates the armor member.

* * * * *